US005875538A

United States Patent [19]

Kish et al.

[11] Patent Number: 5,875,538

[45] Date of Patent: Mar. 2, 1999

[54] METHOD AND APPARATUS FOR COATING FASTENERS

[75] Inventors: Frederick A. Kish, Wheeling; Parimal M. Vadhar; Robert W. Wright, both of Buffalo Grove; William L. Gabriel, Barrington; Geronimo E. Lat, Prospect Heights, all of Ill.

[73] Assignee: Illinois Tool Works Inc., Glenview, Ill.

[21] Appl. No.: 741,946

[22] Filed: Oct. 31, 1996

Related U.S. Application Data

[63] Continuation of Ser. No. 297,003, Aug. 31, 1994, abandoned, which is a continuation-in-part of Ser. No. 121,915, Sep. 17, 1993, abandoned.

[51] Int. Cl.[6] ..... B21G 3/00

[52] U.S. Cl. ..... 29/469.5; 59/71; 427/365; 427/374.4; 427/475; 470/34

[58] Field of Search ..... 118/126; 156/181, 156/273.1, 283; 59/71; 470/34, 35, 36, 40; 427/365, 386, 388.1, 374.4, 475, 486; 29/469.5

[56] References Cited

U.S. PATENT DOCUMENTS

| | | | |
|---|---|---|---|
| 3,234,572 | 2/1966 | Roser | 470/40 |
| 3,390,039 | 6/1968 | Caughman et al. | 156/283 X |
| 3,653,948 | 4/1972 | Kaempgen et al. | 118/126 X |
| 3,773,592 | 11/1973 | Nicolaus et al. | 156/273.1 |
| 3,813,985 | 6/1974 | Perkins | 85/49 |
| 3,862,287 | 1/1975 | Davis | 156/283 X |
| 4,004,061 | 1/1977 | Creighton et al. | 156/283 X |
| 4,275,813 | 6/1981 | Nokes | 59/71 X |
| 4,356,212 | 10/1982 | Stafford | 118/126 X |
| 5,208,077 | 5/1993 | Proctor et al. | 427/461 |
| 5,441,373 | 8/1995 | Kish et al. | 411/903 X |

*Primary Examiner*—Joseph M. Gorski

*Attorney, Agent, or Firm*—Rockey, Milnamow & Katz, Ltd.

[57] ABSTRACT

A method and apparatus for providing a coating on the exterior surfaces of a plurality of elongate members, such as wires, including positioning a plurality of elongate members substantially parallel to each other, coating the exterior surfaces of each member with a coating, removing any excess coating from desired portions of each member and curing the coating to adhere the coating to each member.

6 Claims, 5 Drawing Sheets

Fig. 1
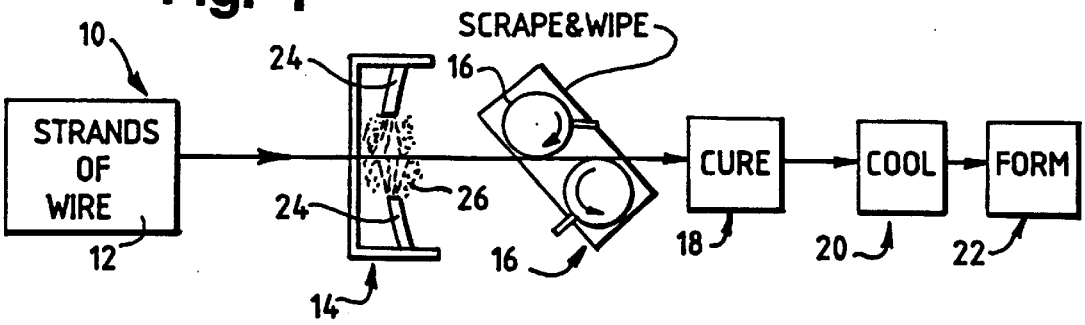
Fig. 2
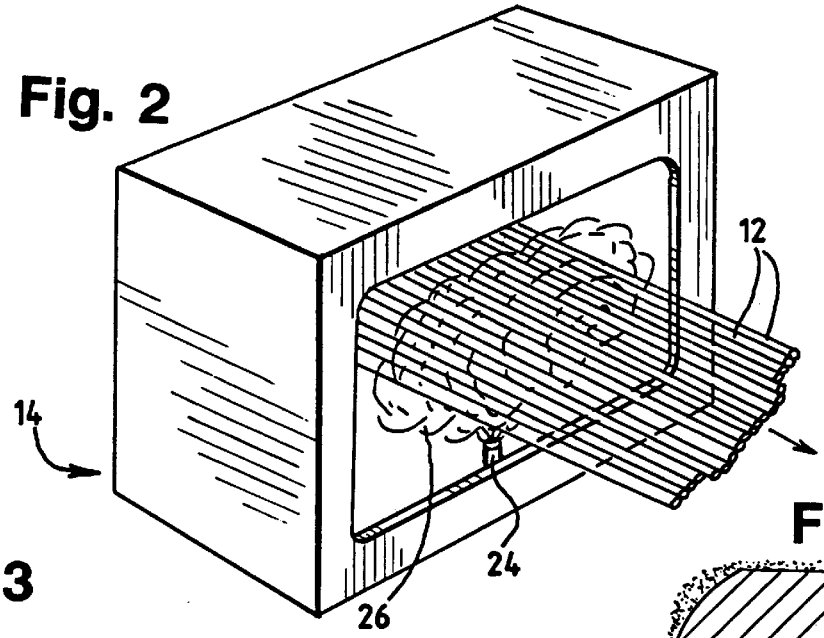
Fig. 3
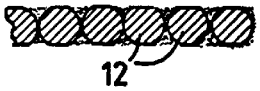
Fig. 4
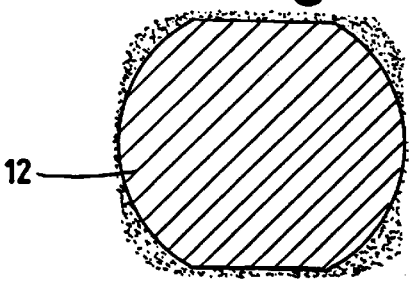
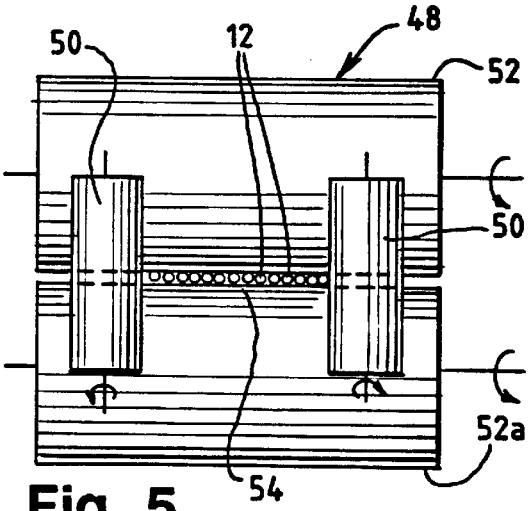
Fig. 5
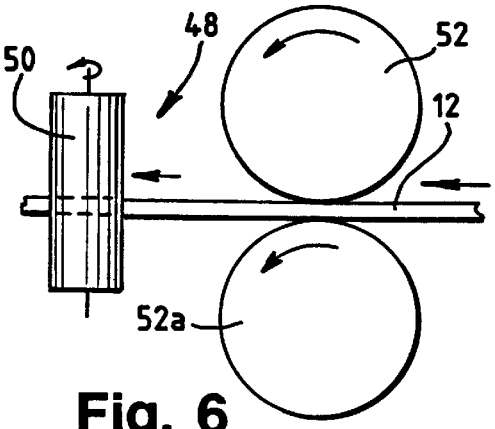
Fig. 6

Fig. 8
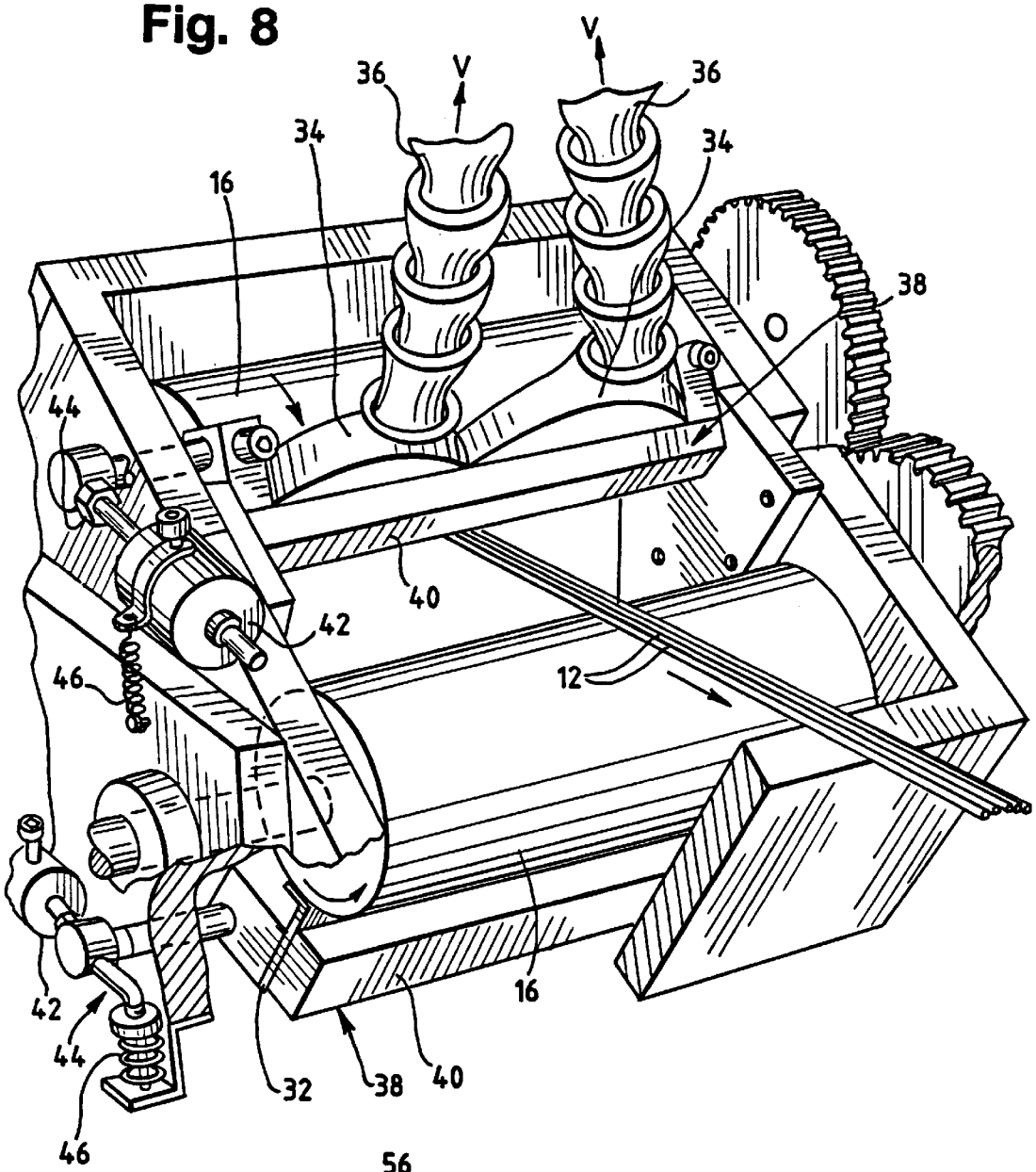
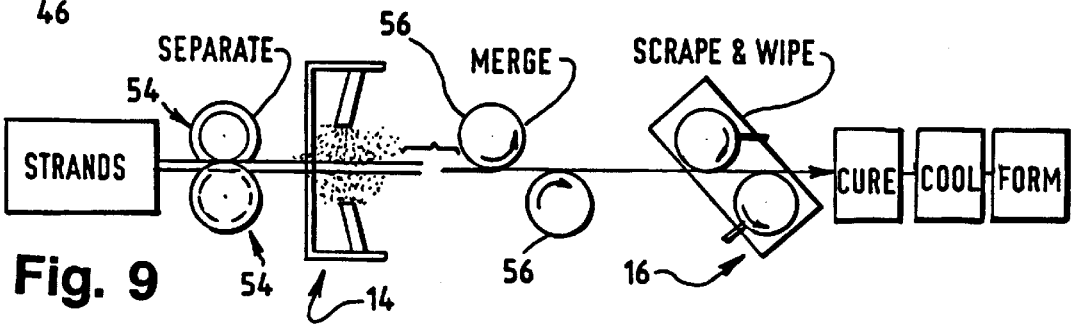
Fig. 9

Fig. 10
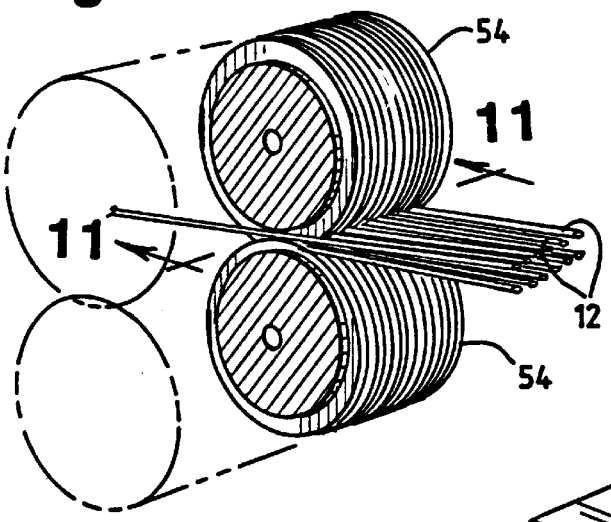
Fig. 11
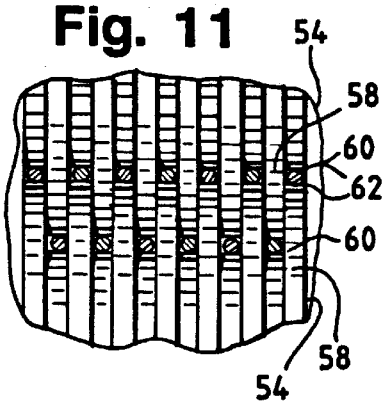
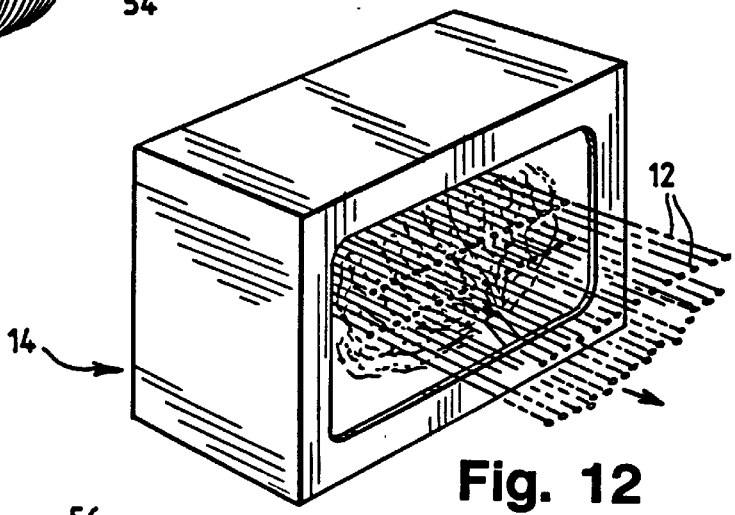
Fig. 12
Fig. 13
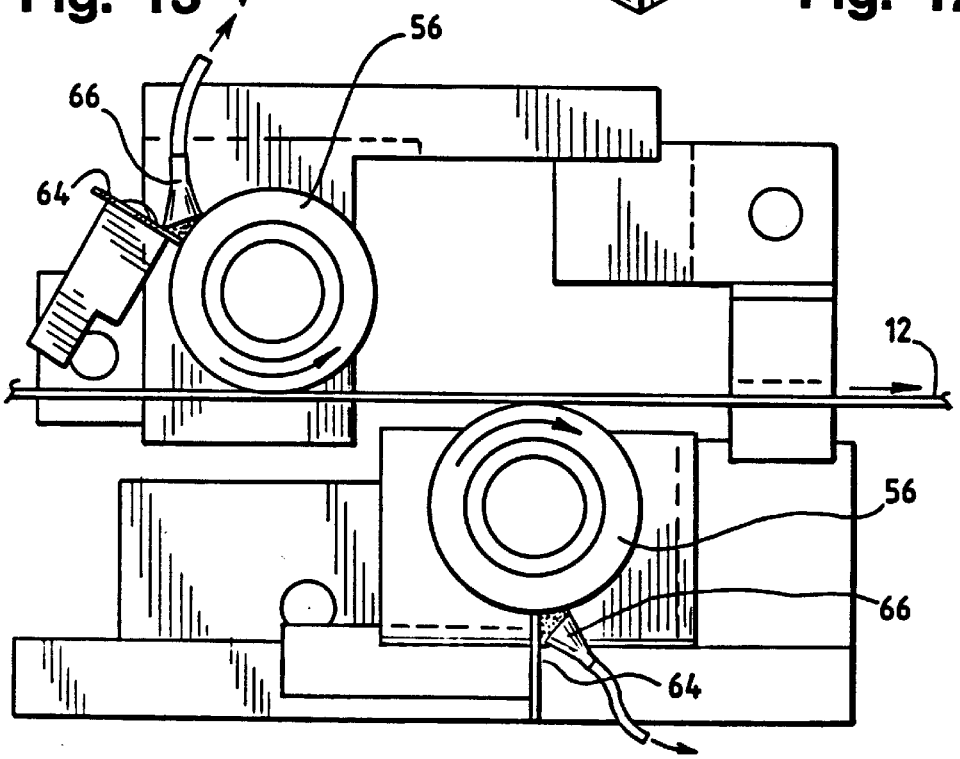

METHOD AND APPARATUS FOR COATING FASTENERS

This application is a continuation of U.S. patent application Ser. No. 08/297,003, filed Aug. 31, 1994, now abandoned, as a continuation-in-part of U.S. patent application Ser. No. 08/121,915, filed Sep. 17, 1993, now abandoned.

BACKGROUND OF THE INVENTION

1. Field of the Invention

This invention relates generally to coated fasteners, and more particularly to a method and apparatus for providing a continuous in-line process for mass-producing coated fasteners, such as staples or nails, arranged in a strip or block for ease of handling and packaging as well as loading into a driving tool. A coating is utilized which is composed of 100% dry solids, is virtually free of solvent emissions when applied and during curing and covers substantially the entire exterior surface of each fastener. The coating protects the fastener against corrosion, adheres successive fasteners together into a strip or block and provides improved retention of the fastener when driven into a desired surface.

2. Description of the Related Art

Coating the exterior surfaces of fasteners frequently is desirable to protect fasteners from corrosion. Such coatings also are utilized to adhere a plurality of fasteners together into a strip or block for ease of handling with fastener driving or dispensing devices, such as a staple gun, nail gun or the like.

For example, wire staples or nails frequently are provided successively arranged and secured in a strip. Each strip contains a desired number of staples or nails which are adhered together by the coating and enable easy insertion of the strip within a magazine of a staple or nail gun.

The coating holds the fasteners together in a strip yet is thin enough to enable insertion of the fasteners within the staple or nail gun and allow for separation of the individual fasteners from the strip upon firing of the gun. Such coatings typically are composed of a nitrocellulose resin dissolved in an organic solvent which is applied to the fasteners. After the solvent is evaporated, the coating remains adhered to the fastener. During solvent evaporation, the coating can be utilized to adhere successive fasteners into a strip. An example of such a coating and process is illustrated in U.S. Pat. No. 3,813,985.

Upon evaporation of the solvent in such coatings, however, a large amount of undesirable volatile compounds are emitted. To conform to existing government regulations, the emitted volatile compounds must be contained and properly disposed which adds significant costs to the process.

Additionally, in that patent the individual fasteners first are formed into their desired shapes before coating and adhering them together into strips. This procedure makes it difficult to handle the individual fasteners and arrange them as required for processing.

It therefore would be desirable to provide a method and apparatus for mass-producing coated fasteners which utilizes a coating composed of 100% dry solids and is virtually free of solvent emissions when applied and during curing where substantially the entire exterior surface of each fastener is provided with the coating. The coating serves to protect the fastener from corrosion, adhere successive fasteners together into a strip and provide increased retention when the fastener is driven into a surface.

SUMMARY OF THE INVENTION

The invention provides a continuous in-line method and apparatus for providing a coating on a plurality of elongate members. The method includes positioning the elongate members substantially in parallel engagement with each other, coating the members with a coating composed of 100% dry solids, removing any excess coating from desired portions of each member and curing the coating to adhere the coating to each member. An important feature of the method and apparatus is that it is virtually free of solvent emissions.

The method and apparatus particularly is useful to provide such a coating on a plurality of continuous wires which are formed into fasteners, such as staples or nails, after curing. When so utilized, the coating additionally functions to adhere successive wires together so that a strip or block of wires are provided which is easier to form the wires into fasteners, package for shipping and storage and load into a driving tool or gun.

Additionally, in order to reduce the shear strength of the coating for easy separation when the fasteners are provided in a strip or block, specific heating and cooling times and temperatures are utilized in curing the coating. Such a decrease in shear strength increases the holding power of the fastener or the corrosion resistance capabilities of the coating.

BRIEF DESCRIPTION OF THE DRAWINGS

FIG. 1 is a schematic view generally illustrating the process and apparatus of the present invention;

FIG. 2 is a perspective view of wires being coated;

FIG. 3 is cross-sectional view of a portion of a strip of wires adhered together by the process of FIG. 1;

FIG. 4 is an enlarged cross-sectional view of a single wire after being removed from the strip of FIG. 3 illustrating the coating thereon;

FIG. 5 is a front elevational view of a roller assembly which can be utilized with the assembly of the present invention;

FIG. 6 is a side elevational view of the roller assembly of FIG. 5;

FIG. 8 is a perspective view, in partial section, of the wire wiper rollers of FIG. 7;

FIG. 9 is a schematic view generally illustrating another embodiment of the process and apparatus of the present invention;

FIG. 10 is an enlarged perspective view in partial section of the wire separating rollers of the present invention;

FIG. 11 is an enlarged elevational view of the wire separating rollers taken along line 11—11 of FIG. 10;

FIG. 12 is a perspective view of the separated wires being coated;

FIG. 13 is a side elevational view of the wire merging rollers of the present invention;

DESCRIPTION OF THE PREFERRED EMBODIMENTS

Figure 7:
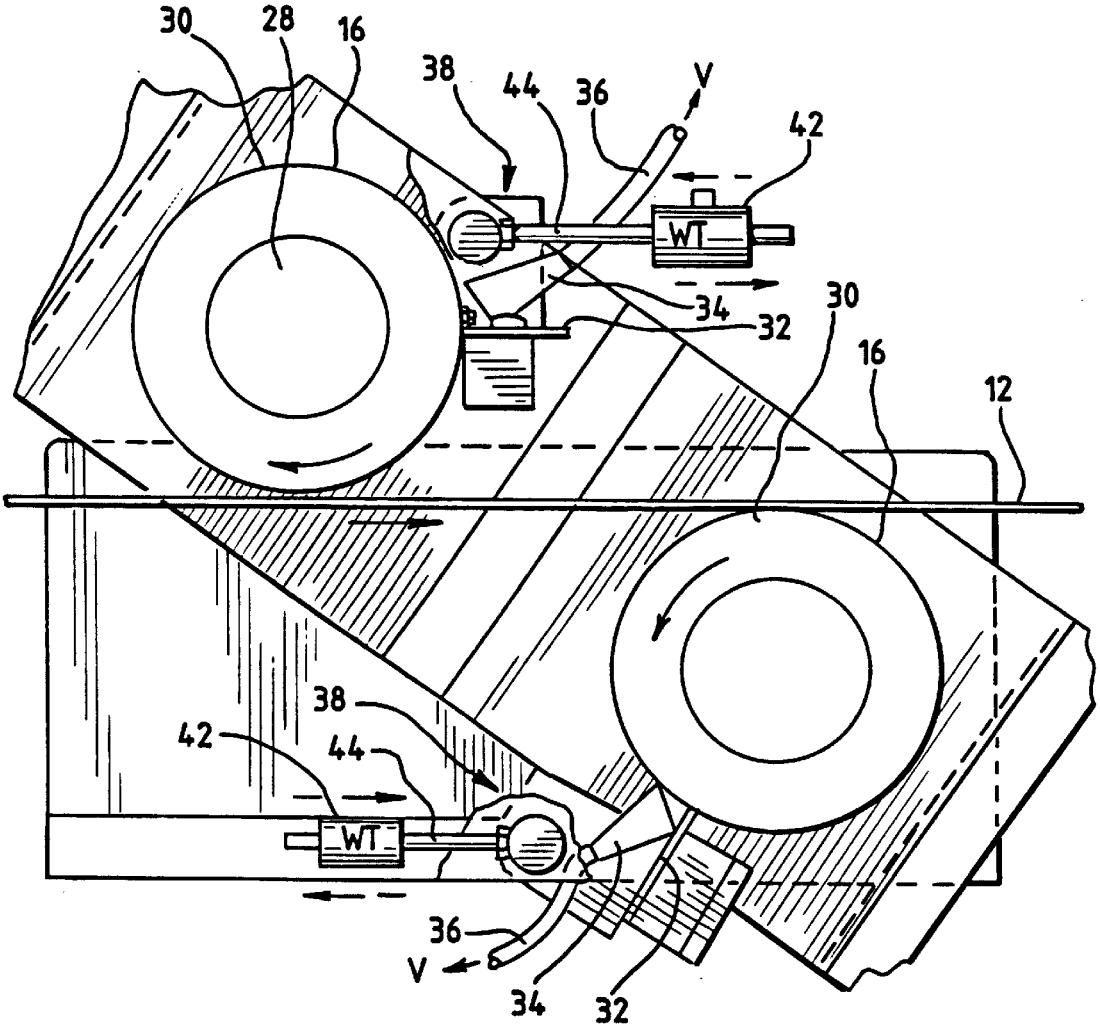
FIG. 7 is a cross-sectional view of the wire wiper rollers of the present invention.

Referring to FIG. 1, the apparatus utilized to perform the method of the invention is designated generally by the reference numeral 10. The method substantially includes the following steps.

A continuous supply of a plurality of wire strands 12 is provided from stock, the wires 12 typically being wound on rolls (not illustrated). The wires 12 are arranged in successive side-by-side parallel engagement and are fed to a coating booth 14. While moving through the coating booth 14, the exterior surfaces of each wire 12 are provided with a 100% dry solids powder coating which preferably is a powder coating provided electrostatically as described below.

Upon exiting the coating booth 14, top and bottom surfaces of the wires 12 are scraped or wiped by a set of wiping rollers 16 which remove excess coating from those surfaces while maintaining a thin coating on the top and bottom surfaces of the wires 12. The wiping rollers 16 also compact the powder coating between the parallel wires 12, as FIG. 3 illustrates, for reasons described hereinafter.

After wiping, the wires 12 are conveyed for curing which preferably includes heating in an oven 18 and subsequent cooling in a cooling chamber 20 or the like. The curing depends upon the type of coating utilized and can vary. Preferably, the curing enables the coating to flow about the exterior surface of the wires 12, adhere the coating to the wires 12 and adhere the wires 12 together into a continuous band. FIG. 3 illustrates a band of wires 12 adhered together by the present process.

Following curing, the adhered band of wires 12 then is shaped into a desired form by a forming machine 22, which typically includes cutting and bending, to provide a strip of fasteners, such as staples or nails. As FIG. 4 illustrates, after a fastener is removed from the strip the majority of coating is concentrated on its corners. A thin layer of coating remains on the top and bottom surfaces as well as the arcuate side surfaces.

The coating can be a powder coating, a U.V. cured coating or a water based coating. Preferably, a powder coating is utilized which can be polyester, polyethylene, nylon, epoxy or other material so long as it functions as described herein.

The best results have been obtained with a polyester/amide based powder coating. An example of such a coating is shown in co-pending U.S. application Ser. No. 08/116,758, filed Sep. 7, 1993 entitled "COATED FASTENER" (Attorney Docket No. 6842), the disclosure of which hereby is incorporated by reference.

That polyester powder coating is composed of 100% dry solids, is applied electrostatically and is cured by heating and subsequent cooling. It is to be understood, however, that the particular coating as well as its application and curing can vary so long as the desired results are obtained, including virtually eliminating the production of harmful volatile compounds during any stage of the process.

The above described process is accomplished in a continuous in-line operation where the wires 12 are advanced at a constant predetermined speed and tension provided by one or more drive motors (not illustrated.) The speed and tension of the wires 12 readily can be adjusted to accommodate different types and sizes of wires 12, different coatings, or both.

Details of the structure of the apparatus 10 utilized for carrying out the process of the invention now will be provided.

As FIG. 1 illustrates, a plurality of wires 12 preferably are fed from rolls of stock in successive side-by-side engagement to the coating booth 14 illustrated in detail in FIG. 2. The wires 12 preferably are made of a conductive metal and are somewhat oval in cross-sectional configuration to provide substantially flat top and bottom surfaces and arcuate opposite sides as illustrated in FIGS. 3 and 4. The particular material, shape and size of the wires 12, however, can vary.

In the coating booth 14 the wires 12 are coated with a powder coating composed of 100% dry solids. As mentioned above, the powder coating preferably is applied using an electrostatic process where powder particles are electrostatically charged as they exit spray guns 24, one each on the top and bottom of the coating booth 14 as illustrated in FIG. 1. The number, position and type of spray guns 24, however, can vary.

As the charged particles exit the spray guns 24, they form a particle cloud ion field 26 through which the grounded wires 12 are passed. The charged powder particles stick to the exposed surfaces of the grounded wires 12 which then are conveyed for further processing. Grounding of the wires 12 is provided by contact of the wires 12 with metal supports (not illustrated) positioned at either end of the apparatus 10, or by some other means.

In order to remove any excess powder coating from the top and bottom surfaces of the wires 12 and provide a predetermined uniform coating thereon, a pair of wiping or scraping rollers 16 are provided which are illustrated in detail in FIGS. 7 and 8. The wiping rollers 16 preferably are driven by one or more motors (not illustrated) and are rotated in a direction opposite to the direction of travel of the wires 12. Alternatively, the wiping rollers 16 can be replaced with some other structure so long as the desired wiping is provided.

As FIG. 7 illustrates, each wiping roller 16 preferably includes a substantially solid core member 28 and an outer softer sleeve member 30. Preferably, the core 28 is made of metal and the sleeve 30 is made of urethane, but the particular materials can vary, including providing solid metal rollers 16, so long as the wiping rollers 16 function as described herein. In operation, the wiping rollers 16 function to maintain a desired amount of coating on the top and bottom surfaces of the wires 12 and to direct coating into recesses between the corners of the wires 12.

It is to be noted that the position of the wiping rollers 16 and their reverse direction of rotation does not diminish the speed of the wires 12. The wiping rollers 16 enhance compacting of the powder coating between wires 12 and do not remove all of the coating from the flat top and bottom surfaces of the wires 12. The rollers 16 only remove excess coating to provide a finished outside perimeter of the wire 12 which readily and consistently can be accepted by a magazine and bore of a driving tool without jamming. The position of the wiping rollers 16 can be adjusted to vary the thickness of the coating on the wires 12.

To remove any accumulation of excess powder coating from the wiping rollers 16, each wiping roller 16 can include a scraper blade 32 and one or more vacuum heads 34. The scraper blades 32 scrape excess coating from the surface of the sleeves 30 and the vacuum heads 34 convey the excess coating through a hose 36 for recycling. Alternatively, air jets (not illustrated) can be utilized in place of the scraper blades 32 and vacuum heads 34 to blow excess coating from the wiping rollers 16 into a recovery container or system.

Rather than being fixed with respect to the wiping rollers 16, the scraper blades 32 and vacuum heads 34 are mounted for automatic adjustment on a support 38. The support 38 functions similar to an idler assembly to accommodate any changes in diameter of the wiping rollers 16.

Preferably, as FIG. 8 illustrates, each support 38 includes an elongate bar 40 which spans a respective wiping roller 16, is mounted on opposite ends for angular adjustment with respect to the wiper roller 16 and mounts both the scraper blade 32 and the vacuum heads 34. To take up slack or reduce pressure between the scraper blades 32 and the wiping rollers 16, a weight 42 is mounted to the bar 40 through an arm assembly 44 and preferably is regulated by a spring 46.

The spring 46 simply can be attached to the weight 42, as illustrated with the top wiping roller 16, or can be provided for engagement with a portion of the arm assembly 44, as illustrated with the bottom wiping roller 16. Alternatively, the spring 46 can be eliminated.

As FIG. 7 illustrates, the weight 42 relies on the force of the spring 46 and/or gravity to provide the engagement force between the scraper blade 32 and wiping rollers 16 which can be adjusted by proper positioning of the weight 42 on the arm assembly 44. It is to be understood, however, that any type of assembly can be utilized to adjust the wiper rollers 16 during use without departing from the teachings of the present invention, including any type of automatic control system.

As FIG. 1 illustrates, after the wires 12 have passed through the wiper rollers 16, they are conveyed for curing, preferably in an oven 18, such as an infrared oven. Due to the composition of the powder coating, heating of the coated wires 12 in the oven 18 to a desired temperature enables the coating to flow about the exterior surfaces of the wires 12 to ensure substantially complete coverage and adhesion upon cooling.

It is to be noted that the coating is virtually free of solvent emissions during application, curing or any other part of the process. This is highly desirable in view of the ever increasing government restrictions against the release of volatile compounds into the atmosphere. It has been determined that emissions of the present process are approximately 1%, with 98% of that amount being moisture.

After heating, the wires 12 are conveyed into the cooling chamber 20 where they preferably are water cooled, but curing with air or any other gas can be provided. When the wires 12 are sufficiently cooled, the coating hardens and the wires 12, which are arranged substantially parallel in successive side-by-side engagement, are adhered together laterally by the coating alone to form a continuous band of wires as illustrated in FIG. 3. Preferably, the number of wires 12 included in the band is between 50–100 and depends only on the size desired for the finished band.

The band of adhered wires 12 then is conveyed for forming into a desired strip or block of adhered fasteners by some type of forming machine 22. Preferably, the band is formed to provide a strip of staples for insertion into a staple gun (not illustrated.) Accordingly, the band of wires 12 first is cut laterally to form a strip of adhered wire segments. The strip then is bent proximate the exposed edge of opposite ends of each wire 12 to form the legs of the staples. The strip of staples then are conveyed for packing. Due to the strong adhesion provided by the coating, wires 12 typically are not split from the band during cutting or bending.

Alternatively, the band of adhered wires 12 can be formed to provide a strip of nails or the like for insertion into a power nail gun (not illustrated.) Accordingly, the band of wires 12 first is cut laterally to form a strip of adhered wire segments. The strip then can be formed at opposite ends of each segment to form a point and a head.

In order to initially position the wires 12 in side-by-side engagement before coating a "glue-block" or die can be utilized. Alternatively, as FIGS. 5 and 6 illustrate, a roller assembly 48 can be positioned prior to the coating booth 14. The roller assembly 48 preferably is a quad-roll assembly including two vertical rollers 50 and two horizontal rollers 52 which rotate in the direction of travel of the wires 12. The roller assembly 48 positions the wires 12 as desired and enables transport of the wires 12 from stock to the coating booth 14.

The particular mounting structure of the rollers 50 and 52 can vary so long as the rollers 50 and 52 are positioned to provide a channel 54 through which the wires 12 extend, the channel 54 being defined by the rollers 50 and 52. Preferably, the rollers 50 and 52 are adjustable and spring loaded with a predetermined variable tension except for a bottom horizontal roller 52*a*, which rotates but is fixed in position.

FIGS. 9–13 illustrate another embodiment of the method and apparatus of the invention where similar elements are identified by the same reference numerals. In this embodiment, a pair of wire separator rollers 54 are positioned before the coating booth 14 and a pair of wire merging rollers 56 are positioned after the coating booth 14. As FIGS. 10–12 illustrate, the separating rollers 54 separate the wires 12 to enable coating of the entire exterior surfaces of the wires 12.

The separator rollers 54 are formed as two stepped, free-rolling interdigitated rollers which are driven by one or more drive motors (not illustrated) in the same direction as the direction of travel of the wires 12 and preferably are formed from metal. The rollers 54 assist in pulling the wires 12 from the rolls and advancing the wires 12 to the coating booth 14 and separate the wires 12 into predetermined positions to expose all sides of the wires 12 to allow full encapsulation thereof during coating.

As FIG. 11 illustrates, each roller 54 includes a plurality of annular lands 58 and corresponding annular grooves 60 formed about their peripheries. To separate the wires 12, the rollers 54 are positioned in a staggered relationship with respect to each other and are interdigitated so that lands 58 of each roller 54 seat within corresponding grooves 60 of the opposite roller.

It is to be noted, however, that the lands 58 do not extend to the bottom of each groove 60 but provide a small pocket 62 within which each wire 12 is positioned. Due to the close tolerances between the wires 12 and pockets 62, the rollers 54 can exert a slight pull on the wires 12 without causing damage thereto.

The separator rollers 54 separate the wires 12 in both a horizontal and a vertical direction with respect to FIG. 11 regardless of how the wires 12 are fed into the separator rollers 54. This separating of the wires 12 provides a substantial amount of free space about the periphery of each wire 12 to enable coating about the entire periphery of each wire 12.

In order to form the wires 12 into a strip or block, the wires 12 preferably are collated or merged back together after coating to form a band of wires 12 which is accomplished by the merging rollers 56. As FIG. 13 illustrates, the merging rollers 56 preferably are substantially identical metal rollers having smooth surfaces where one is positioned above the wires 12 and one below the wires 12.

The merging rollers 56 are driven in the same direction as the direction of travel of the wires 12 by one or more drive motors (not illustrated). Additionally, to provide tension and driving of the wires 12, the merging rollers 56 are positioned so that the vertical gap between the rollers 12 substantially corresponds to the thickness of the wires 12. The speed of the merging rollers 56 as well as the tension they provide readily can be adjusted.

During use, the merging rollers 56 also can accumulate excess coating on their surfaces. To remove such accumulation, each merging roller 56 includes a scraper blade 64 and a vacuum head 66, similar to those of the wiping rollers 16. The blade 64 and vacuum head 66, however, are fixed with respect to the merging rollers 56. Alternatively, air Jets (not illustrated) can be utilized in place of the vacuum heads 66 to blow excess coating from the merging rollers 56 into a recovery container.

Figure 14:
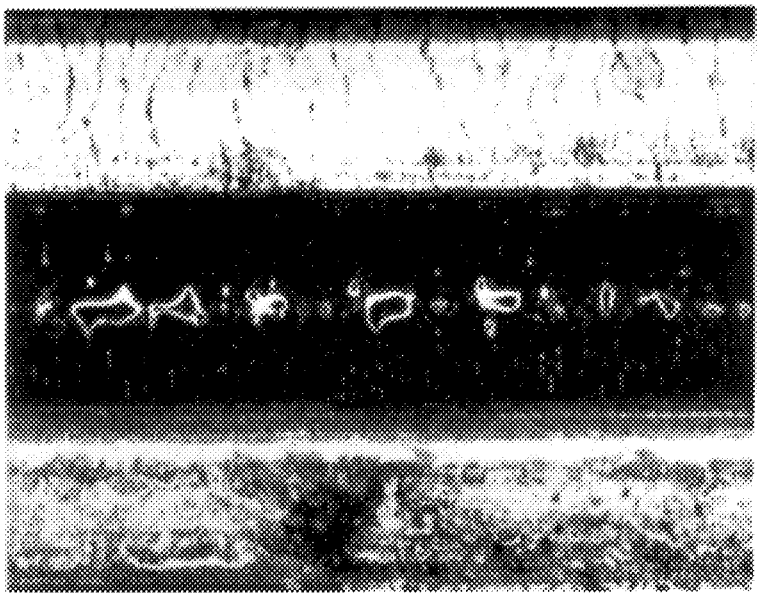
FIG. 14 is an enlarged view of the coating of the invention between two fasteners illustrating the voids within the coating which provide the reduced shear strength of the invention.
Figure 15:
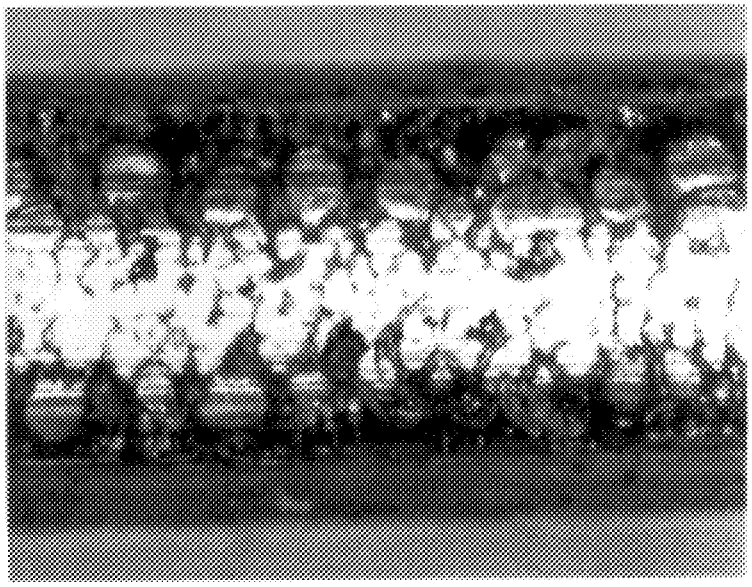
FIG. 15 is an enlarged view of a fastener of the invention after being sheared from an attached fastener illustrating the coverage of the coating that maintains resistance against corrosion and increased holding power and the now broken voids of the coating which provide reduce shear strength.

FIGS. 14 and 15 depict the coating applied to wires 12 by another method of the present invention. FIG. 14 specifically illustrates in substantially lighter color two wires, one each positioned along the top and bottom horizontal edges with a dark horizontal strip therebetween which is the coating joining the wires together. FIG. 15 illustrates a single wire separated from a strip of wires with the coating thereon.

In this embodiment, the coating on the wires 12 is applied by precisely controlling the curing and cooling in the oven 18 and cooling chamber 20, respectively. Specifically, as FIG. 14 illustrates, by quickly heating and quickly cooling the coated wires 12, voids, illustrated as random white shapes, are created in the dark horizontal coating layer.

Such voids are randomly positioned and sized and are created by the water vapor by-products of the reaction which are "frozen" within the coating during rapid cooling. Failure to provide such rapid heating and cooling results in the coating continuing to flow filling up the voids and thus rendering a more solid coating.

Such voids have become important in shearing of the wires or staples in a tool. Without the voids, the coating is very strong in shear which requires a tool that provides high shear force. With the voids, the shear strength is reduced to acceptable limits while increasing the pull out strength of the fasteners during use.

As an example, tests have concluded that heating the wires 12 and coating to a temperature of between 550° and 650° F. within 5 to 12 seconds and then immediately following such heating with a water quench for 1–2 seconds with the water preferable maintained at a temperature of about 70° F. and forming the wire into a staple provides the following results:

A. HOLDING POWER IN SPF WOOD (Lbs./In.)

With Rapid Heating and Water Quenching 228±41

Without Rapid Heating and Water Quenching 195±49

B. Shear Strength (Lbs.)

With Rapid Heating and Water Quenching 49±13

Without Rapid Heating and Water Quenching 122±21

It is to be noted that the above results can vary substantially between tests, primarily because of the differences of the wood sample being utilized. For example, factors such as the age, moisture content and grain, among other factors, significantly can affect the test data. The ratios between rapid heating/cooling and normal heating/cooling, however, should remain substantially the same so long as the same piece of test wood is being utilized.

Modifications and variations of the present invention are possible in light of the above teachings. It therefore is to be understood that within the scope of the appended claims the invention may be practiced other than as specifically described.

What is claimed and desired to be secured by letters patent is:

1. A method of providing a strip of coated fasteners, comprising the steps of a) providing a plurality of metal wires positioned substantially in parallel engagement with each other;

b) electrostatically covering the exterior surfaces of each wire with a material composed substantially of solid particles;

c) removing any excess material from desired portions of said wires;

d) curing the material, thereby causing said solid particles to adhere to one another and to said wires, such that said wires become adhered to one another and form a continuous band of parallel wires;

e) cooling said coating material after said curing step, thereby forming a coating having voids therein such that a shear strength of the coating is less than a shear strength that would have resulted from the particles adhering together and forming a coating having no voids therein; and f) forming said band of parallel wires into fastener strips.

2. The method as defined in claim 1 wherein said curing step includes heating said material to a predetermined temperature and subsequent cooling such that virtually no solvent emissions are produced.

3. The method as defined in claim 1 including, before step b), separating said wires into predetermined parallel positions with respect to each other and, after step b), merging said wires together so they are positioned substantially in parallel engagement with each other.

4. The method as defined in claim 1 including performing steps a)–f) by continuously passing said plurality of metal wires through a plurality of stations.

5. The method as defined in claim 1 wherein said curing step includes heating to a temperature of between 550° and 650° F. for 1–12 seconds and said cooling step includes cooling said material immediately after said heating step.

6. The method as defined in claim 5 wherein said cooling includes quenching with water at about 70° F.

* * * * *